US005172502A

United States Patent [19]

Kober

[11] Patent Number: 5,172,502

[45] Date of Patent: Dec. 22, 1992

[54] FLATWORK FEEDER HAVING FLATWORK SENSING AND CLAMPING STATIONS

[75] Inventor: Kasimir Kober, Niles, Ill.

[73] Assignee: Chicago Dryer Company, Chicago, Ill.

[21] Appl. No.: 719,253

[22] Filed: Jun. 21, 1991

[51] Int. Cl.[5] ..... D06F 67/04

[52] U.S. Cl. ..... 38/7; 38/8; 38/11; 38/143; 271/3; 414/13

[58] Field of Search ..... 38/1 R, 7, 8, 9, 11, 38/12, 143; 271/3, 10; 198/464.2; 414/13; 26/51, 71, 90; 223/37; 493/442, 444

[56] References Cited

U.S. PATENT DOCUMENTS

| | | | |
|---|---|---|---|
| Re. 31,453 | 12/1983 | Olsen et al. | 38/143 |
| 1,703,586 | 2/1929 | Jahnke | 38/8 X |
| 3,136,081 | 6/1964 | Fredholm | 38/143 |
| 3,421,756 | 1/1969 | Weir | 271/79 |
| 3,470,636 | 10/1969 | Withorn | 38/143 |
| 3,509,650 | 5/1970 | Orkney et al. | 38/7 X |
| 3,553,863 | 1/1971 | Sjostrom | 38/143 |
| 3,729,846 | 5/1973 | Weir | 38/143 |
| 3,736,678 | 6/1973 | Kamberg | 38/143 |
| 3,791,055 | 2/1974 | Bazelmans et al. | 38/11 |
| 4,106,227 | 8/1978 | Allen et al. | 38/143 |
| 4,143,476 | 3/1979 | Holmes et al. | 38/7 |
| 4,299,521 | 11/1981 | Jensen | 38/143 X |
| 4,671,001 | 6/1987 | Ferrage et al. | 38/8 X |
| 4,991,326 | 2/1991 | Weir | 38/143 |

FOREIGN PATENT DOCUMENTS

| | | | |
|---|---|---|---|
| 0668556 | 12/1965 | Belgium | 38/143 |
| 0105329 | 12/1962 | Denmark | 38/7 |
| 8302080 | 1/1985 | Netherlands | 38/7 |
| 2091299 | 7/1982 | United Kingdom | 38/7 |

*Primary Examiner*—Werner H. Schroeder
*Assistant Examiner*—Ismael Izaguirre
*Attorney, Agent, or Firm*—Fitch, Even, Tabin & Flannery

[57] ABSTRACT

A feeding aid for assisting in the feeding of laundry flatwork to laundry processing equipment such as an ironer. The air comprises spaced clamping stations including at least one pivotally mounted clamping wheel which is actuated into a lowered clamping position when a leading edge of a piece of flatwork such as a sheet is sensed beneath an associated laundry sensing device such as a photosensor. After one corner is clamped in place, the sheet leading edge is drawn taut and the opposite sheet corner portion is placed beneath the clamping wheel in a second clamping station. The clamping action of the two stations prevents the weight of the sheet depending from the feed conveyor from causing the sheet to fall by gravity from the conveyor. After a short time delay following clamping by a second clamping wheel, the feed conveyor on which a sheet or the like is clamped is actuated to feed the sheet into engagement with an ironing cylinder or the like. In modified aids, slidable shoe or runners may be substituted for wheels.

10 Claims, 2 Drawing Sheets

FLATWORK FEEDER HAVING FLATWORK SENSING AND CLAMPING STATIONS

BACKGROUND OF THE INVENTION

1. Field Of The Invention

This invention relates to an aid for use in the feeding of the sheet material, and more particularly relates to the feeding of laundry flatwork such as sheets, table cloths, and the like to laundry processing equipment such as an ironer.

2. Background Art

The use of feeding apparatus for assisting in the feeding of flatwork such as sheets to laundry processing apparatus such as ironers is well known in the laundry art.

Among the various feeding devices of the prior art are Weir U.S. Pat. No. 3,421,756 directed to a laundry feeding machine which is composed of a plurality of moving mechanisms. This patent discloses the use of clamp pairs for engaging the opposed corners of a sheet leading edge, spreading such clamps apart, advancing such sheet edge over a conveyor, and releasing the sheet leading edge onto the underlying conveyor.

Weir U.S. Pat. No. 3,729,846 discloses sheet corner-engaging clamps, and means for moving the clamps apart in combination with air-blast means for blowing a released sheet forwardly into an underlying conveyor.

Kamberg U.S. Pat. No. 3,736,678 assigned to the assignee of the subject application is directed to a feeder apparatus employing spreading brushes and vacuum boxes to assist in feeding a substantially wrinkle-free sheet onto a feed conveyor.

Olsen et al. U.S. Pat. No. 31,453 is directed to laundry feeding apparatus employing pairs of transverse clamps arranged over a feed conveyor and which are attachable to corners of a sheet or the like. The clamps apply desired tension on the sheet leading edge and position the same relative to a feed conveyor.

Holmes et al. U.S. Pat. No. 4,143,476 is directed to a laundry arranging device for transporting laundry items to laundry ironing equipment. The device includes spaced clamping heads attached to continuous chains for engaging a sheet leading edge whereafter a feeder device picks off the laundry item from the releasable clamps.

Weir U.S. Pat. No. 4,991,326 is directed to laundry handling apparatus employing a movable article clamp operated by fluid pressure which is valved in a particular manner whereby an article engaged by the clamp is released at a discharge station whereat the pressure in the clamp means is released.

None of these prior art references discloses the simple feeding aid of this invention composed of at least two groups of pivotal clamping wheels and associated actuating means. The prior art feeding devices are normally more complicated and expensive, and as a result more subject to malfunction than the feeding aid hereinafter described in greater detail.

It is an object of this invention therefore to provide a simple clamping aid which may be readily retrofitted into already existing ironers or folders or incorporated into new ironers, ironer-folders or folders or arranged in discrete feeding devices for the latter.

It is another object of this invention to provide a simple feeding aid which employs two stationary feeding stations having a minimum number of simple moving parts.

It is a further object of this invention to provide a feeding aid for laundry flatwork which is flexible in operation and enables the feeding of large sheets with a single operator, or similarly efficiently functions with two sheet feeding operators for feeding laundry flatwork to an ironer or the like.

SUMMARY OF THE INVENTION

The feeding aid of this invention comprises at least two spaced clamping stations at which a single operator may clamp opposed ends of a laundry flatwork item such as a bed sheet prior to feeding the sheet by means of a conveyor underlying the feeding stations into engagement with laundry processing equipment such as an ironer, ironer-folder or folder. Each feeding station includes at least one pivotally movable clamping wheel movable from a retracted position over a feed conveyor into a towered clamping position in engagement with the conveyor upper surface. By moving a portion of a sheet leading edge beneath a clamping wheel of a first station, a photosensor or equivalent means, senses the sheet leading edge. An actuating means such as a motor is then energized by a signal initiated by the photo sensor to move the clamping wheel through connecting linkages against the underlying sheet portion.

With one corner of the sheet leading edge clamped in position, the operator pulls the remaining sheet edge portion taut beneath clamping wheels of a second clamping station. A second laundry sensing eye then actuates a second motor to urge the second clamping wheel or wheels into engagement with the second sheet edge portion. After a short time delay, the feed conveyor against which the sheet is clamped by the wheels of the spaced station is actuated to feed the sheet into engagement with laundry processing means such as an ironer cylinder, as will hereinafter be described in greater detail.

For a more complete understanding of this invention reference will now be made to the following detailed description when read in the light of the appended claims and accompanying drawings in which:

DESCRIPTION OF THE DRAWINGS

FIG. 1 is a fragmentary perspective view illustrating a feeding aid of this invention incorporated in an ironer folder for processing laundry flatwork such as sheets or the like;

DESCRIPTION OF THE PREFERRED EMBODIMENT

Figure 2:
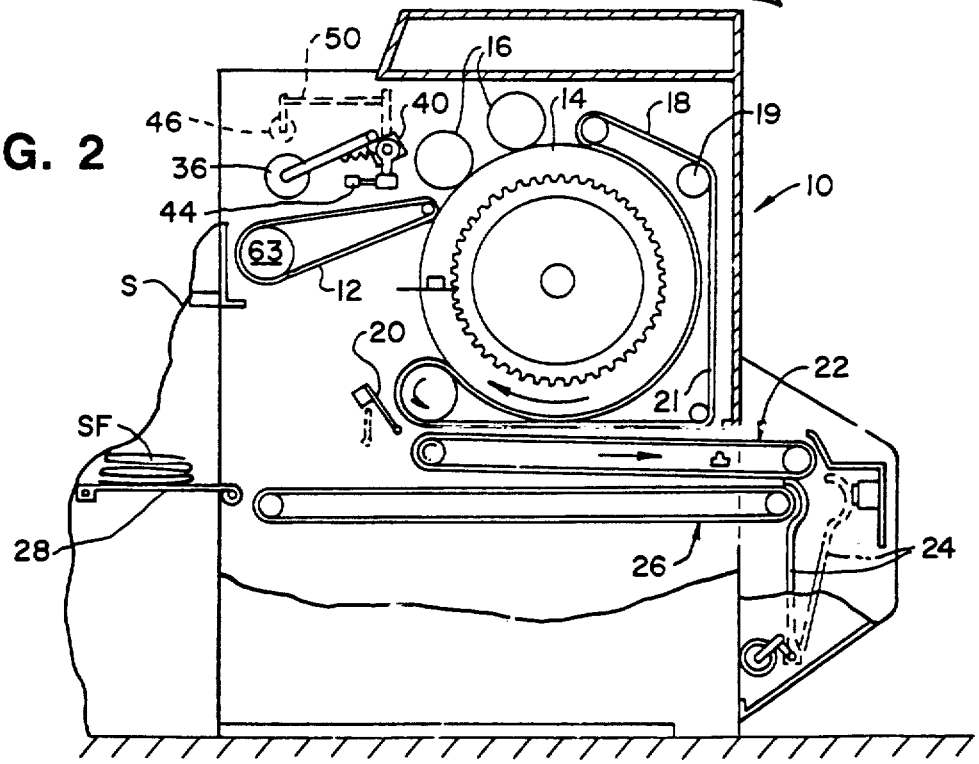
FIG. 2 is a side elevational view, partly in section of the apparatus of FIG. 1.

Referring now more particularly to FIG. 2, a schematic side elevational view is illustrated of an ironerfolder 10 of the type sold by assignee of the subject application Chicago Dryer Company in a variety of ironing cylinder sizes. An ironer-folder apparatus similar to that illustrated in this application is disclosed in Kober et al. application, Ser. No. 07/488,716 filed Mar. 5, 1990 now U.S. Pat. No. 5,079,867, assigned to the assignee of this application. The disclosure of such application is incorporated herein by reference.

It will be noted from FIG. 2 that the ironerfolder 10 has a feed conveyor 12 onto which a sheet S or other large piece of laundry flatwork is fed at the left hand feed end of the apparatus. Conveyor 12 will move flatwork such as a sheet S into engagement with a heated ironing cylinder 14 which may be internally heated by gas, electricity or steam. Upon leaving the end of the feed conveyor 12, the flatwork passes between compression rolls 16 and the smooth outer periphery of the ironing cylinder 14. The sheet is then guided by continuous guide ribbons 18 about a major peripheral portion of the cylinder 14. At the lower end of ribbons 18, sheet S is guided by fingers 20 onto an upper receiving conveyor 22. Upper runs of the continuous ribbons comprising conveyor 22 move to the right as illustrated in FIG. 2, at the end of which the ironed sheet S depends from the conveyor 22. Simultaneously, actuating and timing mechanisms not illustrated but known in the art, pivotally actuate folding blade arm 24 to move from the full line position of FIG. 2 into the phantom line position of FIG. 2 and back into the full line position in a manner as disclosed in above-noted application Ser. No. 07/488,716. The flatwork such as sheet S, which has been transversely folded into quarters (or other programmed fraction) has the longitudinal mid-point thereof wedged between the bottom runs of upper conveyor 22 and the upper runs of lower conveyor 26 for discharge onto a receiving platform 28 at the left feed end of the apparatus.

FIG. 2 illustrates a sheet SF in the folded condition after being ironed and folded by the apparatus 10. The foregoing ironing and folding operations are presented by way of background only for the feeding aid of this invention, and the apparatus 10 is illustrative of a laundry processing device with which the aid of this invention is intended for use.

It is apparent that in the feeding of damp, king-size bed sheets which may be 120 inches wide, in the absence of sophisticated and expensive feeding devices, two feeding operators are necessary for purposes of feeding such sheet. Sheets such as sheet S of FIG. 2 should be at least about 54 inches in width before the feeding aid of this invention is employed, as smaller items may be fed onto the feed conveyor without the need for a clamping aid.

It is believed apparent that in the normal work day, in the event two feed operators are necessary for feeding wide sheets, many occasions arise during which one operator may depart. One operator may leave the apparatus for purposes of moving the ironed flatwork to a new location, or for bringing in a load of dampened laundry for feeding into the apparatus. It is believed equally obvious that during the course of the normal workday, periodic rest breaks are taken by the flatwork feeding personnel. By utilizing the feeding aid of this invention, in those instances in which a single operator is present, such operator may continue to feed large flatwork such as king-size sheets onto the feed conveyor 12 of the apparatus 10 without the necessity of ironer shut down and without the need for extremely expensive feeding devices known in the art which commonly employ separate clamps for engaging opposed corner portions of the leading edge of the flatwork being fed onto the feed conveyor.

Figure 1:
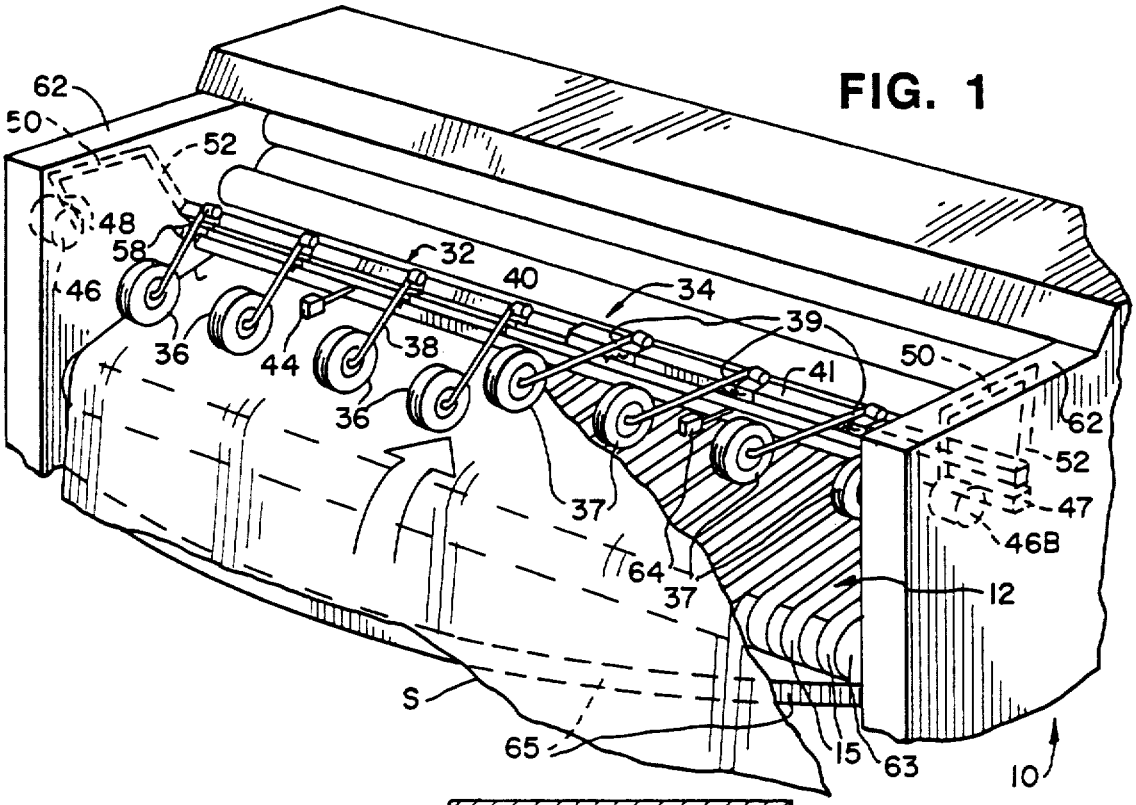

Referring to FIG. 1 it will be noted that the feeding aid of the subject invention comprises discrete series 32 and 34 of rotatable clamping wheels 36 and 37 respectively which are rotatably mounted on terminal ends of supporting rods 38 and 39 respectively. The proximal ends of rods 38 and 39 are connected to rotatable bars 40 and 41 respectively which are supportedly mounted in spaced bearing arms 49 an a stationary transverse support tubing 47 as seen more clearly in FIG. 3 in which one bearing arm is illustrated. It is thus seen that the latter described wheel, rod and bar elements of even number define a clamping station 32 whereas the wheels, rods and bar bearing odd numbers define a clamping station 34.

Figure 3:
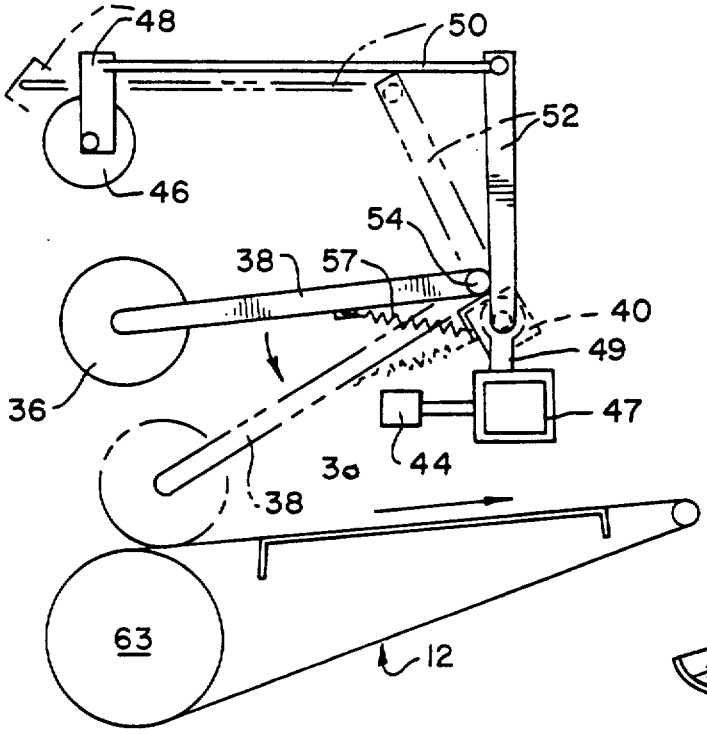
FIG. 3 is a side elevation view illustrating a clamping roller employed in a flatwork clamping station of the invention of this application together with associated components schematically illustrated.

In the normal course of feeding aid operation, a single operator may grasp one corner such as the left hand corner of sheet S to be ironed, and place the same beneath wheels 36 associated with the clamping station 32. A laundry sensing device such as a photosensor 44 which may be supported by tubing 47 as seen in FIG. 3, senses the corner of the sheet in the course of being placed by the operator beneath the wheels 36 onto the supporting surface of conveyor 12. The photosensor may of a type well known in the art such as sold under the brand name MICRO-SWITCH MODEL FE 78. On sensing such sheet corner portion, a motor 46 (See FIG. 3) which is connected to rotatable bar 40 through linkage arms 48, 50 and 52 is actuated to rotate counterclockwise as illustrated in FIG. 3, a fraction of a revolution thereby lowering the clamping wheels 36 from the elevated full line position illustrated, to the lowered position illustrated in phantom line. It will be noted from FIG. 3 that the proximal end of wheel-supporting arm 38 is not rigidly joined to bar 40 but is connected thereto by means of a pivotal connection 54. A spring 57 extending between rod 38 and bar 40 allows tensioned, pivotal movement of arm 38 relative to the supporting bar 40 after the wheels engage conveyor 12. When bar 40 is rotated by motor 46 and the attached linkages to raise the wheels, the top of the bar 40 engages an adjacent portion of arm 38 and urges the same upwardly. FIG. 3 also illustrates the desired disposition of wheel 36 over a portion of underlying roller 63 of conveyor 12 to assure desired frictional retention of a sheet between the wheels 36 and ribbon portions overlying roller 63.

With the wheels 36 in the lowered clamping position, as illustrated in FIG. 1, a single sheet feeding operator for the apparatus 10 then pulls the leading edge of the illustrated sheet S transversely beneath the wheels 37 of the adjacent clamping station 34, care being taken to insure that the sheet leading edge is substantially taut and transversely disposed to the longitudinal axes of spaced continuous ribbons 15 comprising the feed conveyor 12. A transverse spreading bow 65 seen in FIG. 1 assists in spreading the sheet S in the course of being fed onto the conveyor 12 for purposes of assisting in removing wrinkles from the sheet S in the course of being fed. To assist in the proper transverse alignment of the sheet leading edge, a marking indicia such as an arrowhead 58 may be disposed at the appropriate opposite locations on inner walls of the opposed side walls 62, the arrowhead 58 of left sidewall 62 being illustrated in FIG. 1.

In the course of the sheet feeding operator moving the right end of sheet S into the appropriate transverse disposition on the feed conveyor 12, photosensor 64 associated with clamping station 34 will sense the sheet edge. Photosensor 64 will emit a signal, actuating motor 46B mounted in right sidewall 62 of the apparatus 10 as illustrated in phantom line in FIG. 1 to rotate through a fraction of a revolution so as to pivotally move bar 41 supporting the rods 49 and wheels 37 into the lowered clamping position through a linkage arrangement similar to that of FIG. 3, and illustrated in phantom line in FIG. 1. The leading edge of sheet S will then be clamped in place across its entire width on the feed conveyor 12.

Figure 4:
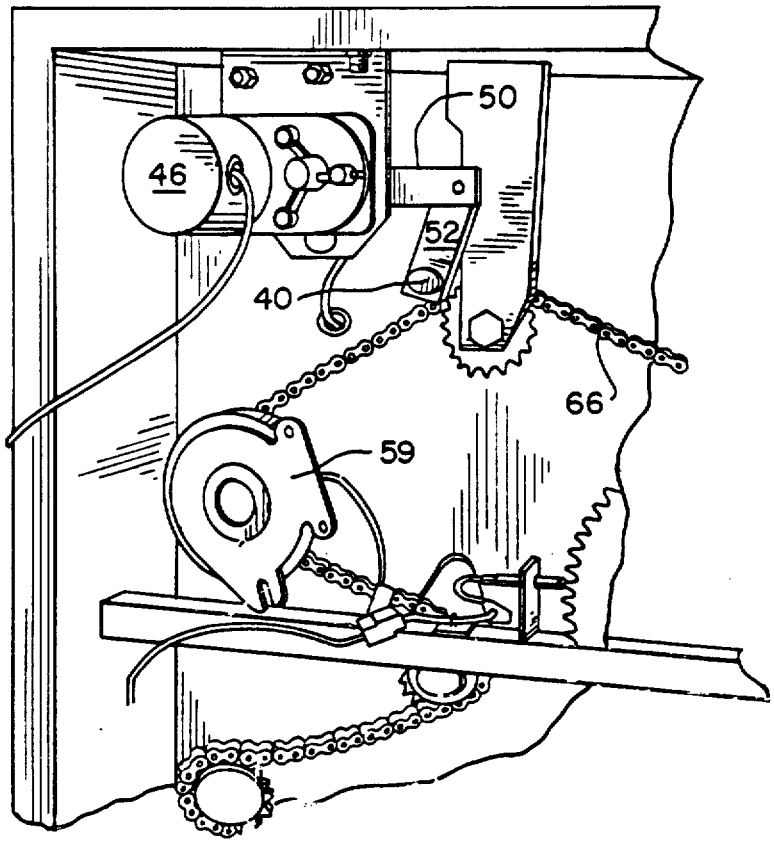
FIG. 4 is a fragmentary perspective view illustrating a clutch mechanism and chain drive employed for moving the various conveyors employed in the illustrated ironer-folder in which the feeding aid in this invention is incorporated.

It will be noted from FIG. 2 that with the sheet clamped in this position, the major portion of the sheet S will depend from the feed conveyor 12, drape about the receiving table 28 and in most instances rest on the underlying floor on which the apparatus 10 is supported. The clamping wheels 36 and 37 of the two stations 32 and 34 thus prevent the weight of the sheet depending from the clamped leading edge from allowing the sheet S to fall by gravity from the feed conveyor 12. After all wheels of the clamping stations are lowered into the clamping position, and after a short time delay of about 4 seconds, clutch 59 (see FIG. 4) is energized to connect roller 63 of the feed conveyor 12 (see FIG. 1) to the continuously moving drive chain 66 of the apparatus 10 as illustrated in FIG. 4. In the normal course of operation of the apparatus 10, a main drive motor (not illustrated) continuously rotates ironing cylinder 14, the associated compression rolls 16 and rollers 19 associated with return ribbons 21 employed for moving the flatwork being ironed about the periphery of the cylinder 14 as illustrated in FIG. 2. However, as the feed conveyor must be capable of stop-and-go operation to allow the flatwork feeding personnel to clamp the leading edges beneath the wheels of the two clamping stations above described, drive roller 63 therefore is only rotating when clutch 59 is energized and such energization is controlled by photosensor 64 as above described. The clutch may also be energized independently of the photosensors by a switch controlled by the feeding personnel, if desired.

After a short time delay of the order of 4 seconds which is adequate to insure entry of the leading sheet edge between the compression roll 16 disposed adjacent the feed conveyor 12 (See FIG. 2) the actuating motors 46 and 46B rotate the wheel supporting bars 40 and 41 so as to raise the clamping wheels 36 and 37 into the elevated position, in condition for receiving the next piece of flatwork.

As is apparent from the drawings, one of the advantages of the simple aid of this invention is that the same may be readily retrofitted into an existing piece of laundry apparatus such as a basic ironer-folder of the type exemplified by FIG. 10. The apparatus 10 may of course, be incorporated in an ironer only, without any cooperating folding elements, or may be incorporated in a folder only which may be any of various types well known in the art. It is believed that FIG. 1 is illustrative of the ease with which the necessary actuating mechanism for each series of clamping wheels of each clamping station may be located within the hollow frame side walls 62 illustrated. The provided aid may thus be inserted in place in an already existing ironer-folder. It is believed equally obvious that the feeding aid of this invention may comprise a discrete unit in which the feed conveyor of the aid is placed in series with the feed conveyor of an already existing ironer, ironer-folder or folder.

Figure 3A:
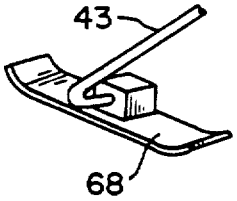
FIG. 3A is a fragmentary perspective view of a clamping runner which may be substituted for wheels in a clamping station of this invention.

It is believed apparent to those skilled in the art that the clamping wheels 36 and 37 may be substituted by a non-rotatable clamping element such as a plastic shoe or runner 68 illustrated in FIG. 3A supported on an arm 43 which may in turn be connected at its proximal end to a pivotable bar such as the previously described bars 40 and 41. The shoes 68 should preferably be spring biased against the underlying feed conveyor in the manner of the wheels 36 and 37 in the manner above described and may be mounted on rod 43 so that the lower surface thereof is in the approximate plane of the conveyor when lowered. The shoe may also pivotally move through a small arc when in slidable engagement with the underlying flatwork. The material of formation of the shoe 68 should desirably have a low coefficient of friction.

It should also be appreciated by those skilled in the art that although two clamping stations are illustrated in the drawing, feeding aids employing 4 or more clamping stations are contemplated as being within the scope of this invention. The use of extremely wide conveyors having multiple feeding lanes in folders and ironers is known in the art. Accordingly, it is within the spirit of this invention to encompass feeding aids in which two or more feeding personnel individually utilize two clamping stations for purposes of feeding flatwork onto one lane of a multi-laned conveyor leading to a laundry processing apparatus such as an ironer or the like. In an alternative arrangement one apparatus operator may feed large pieces in one lane of the conveyor employing the aid, and a second operator may feed small pieces onto an adjacent lane without the need for an aid.

Also, although a plurality of wheels are illustrated for use in conjunction with the two clamping stations illustrated in the drawing, it is believed to be apparent that a single wheel at each station could appropriately function for clamping purposes, particularly when sheets of a single size only are being fed, the use of multiple wheels in each feeding station enables sheets of varying width to have their corner portions clamped in place prior to actuation of the feed conveyor in the manner above described. The two stations may have different numbers of wheels to provide for optimum adaptability in engaging different sheet sizes. Both stations of the feeding aid may be readily deactivated by deenergizing the photosensors and allowing the wheels to remain in the retracted position. In such position and with clutch 59 energized small laundry items such as towels and pillow cases may be fed by one or more operators onto the conveyor 12 without the need for the aid. If two feeding personnel are available for feeding large pieces, the aid may be manually deactivated if desired.

Other modifications of the apparatus described will become apparent to those skilled in the art. Accordingly, it is intended that this invention be limited only by the scope of the appended claims.

I claim:

1. A feeding aid for laundry flatwork comprising at least two clamping stations; a laundry flatwork feeding conveyor disposed beneath said clamping stations for feeding flatwork into engagement with laundry processing means; means associated with said feed conveyor for actuating said conveyor into alternate stop and moving conditions; each clamping station having a clamping element comprising a shoe for slidably engaging flatwork disposed on said conveyor and movable from a retracted position above said conveyor to a lowered clamping position in which said element is biased against said conveyor; means for lowering said clamping element into the lowered clamping position when laundry flatwork is disposed beneath said clamping element; said feed conveyor being in the stop condition when at least one of said clamping elements is in the retracted position; and means for placing the conveyor actuating means in the conveyor moving condition after clamping elements of said at least two clamping stations are in the lowered clamping position.

2. A feeding aid for laundry flatwork comprising a flatwork conveyor for feeding flatwork along a path of travel and into engagement with laundry processing means; means associated with said flatwork conveyor for actuation said conveyor into stop and moving conditions; spaced clamping stations disposed adjacent the path of travel of said flatwork conveyor; each clamping station comprising a laundry flatwork clamping means movable from a retracted position above said conveyor to a lowered clamping position when laundry flatwork is disposed on said conveyor adjacent said clamping means; each clamping station also comprising means for biasing an associated clamping means toward said conveyor whereby flatwork engaged by said clamping means is clampingly urged against said conveyor while allowing such laundry flatwork engaged by said clamping means in the lowered position to move with such movable conveyor relative to said clamping means; laundry flatwork sensing means disposed adjacent said clamping means for sensing the presence of laundry flatwork disposed on said conveyor and beneath said clamping means in the retracted position; the clamping station biasing means being responsive to said laundry sensing means for lowering said clamping means into the lower flatwork engaging position when said laundry sensing means senses the presence of laundry flatwork.

3. A feeding aid for clamping laundry flatwork in position on a movable conveyor for feeding laundry flatwork to laundry processing means; said feeding aid comprising retractable clamping means movable between an upper retracted position above such conveyor and a lowered flatwork engaging position in which laundry flatwork disposed on such conveyor is urged by said clamping means against the movable conveyor; means for biasing said clamping means against such movable conveyor in such manner as to allow laundry flatwork engaged by said clamping means to move with such movable conveyor relative to said clamping means in the lowered position; laundry sensing means disposed adjacent said clamping means for sensing the presence of laundry flatwork when disposed on such conveyor beneath said clamping means in the retracted position; means responsive to said laundry sensing means for activating the clamping means biasing means and lowering said clamping means into the lowered flatwork engaging position when said laundry sensing means senses the presence of said laundry flatwork; and means sensitive to the lowered position of said clamping means for actuating such movable conveyor to feed laundry flatwork with said laundry clamping means in the lowered position.

4. The feeding aid of claim 1, 2 or 3 in combination with spreading means disposed adjacent a leading edge of the flatwork conveyor for removing wrinkles from a laundry flatwork portion depending from said conveyor.

5. The feeding aid of claim 2 or 3 in which each clamping station comprises a plurality of spaced clamping wheels pivotally mounted on a rotatable support disposed above said feed conveyor.

6. The feeding aid of claim 2 or 3 in which each clamping means is moved into the retracted position by said biasing means following engagement of laundry flatwork fed by said aid with such laundry processing means.

7. The feeding aid of claims 2 or 3 in which said clamping means comprises a rotatable wheel.

8. The feeding aid of claims 2 or 3 in which said clamping means comprises a shoe for slidably engaging flatwork disposed on the conveyor.

9. A method for feeding laundry flatwork on a movable conveyor to a laundry processing means comprising the steps of positioning a portion of the leading edge of an item of laundry flatwork on a stationary conveyor beneath a retractable clamping means responsive to a laundry flatwork sensing means and movable into an elevated position spaced from and a lowered position biased toward such conveyor; sensing the presence of such flatwork portion beneath said retractable clamping means and actuating said retractable clamping means into the lowered position biasing such flatwork leading edge portion against such movable conveyor; tensioning a portion of the flatwork leading edge extending from such leading edge portion engaging such clamping means until such leading edge is in a substantially taut condition on said conveyor; and actuating such movable conveyor to convey such laundry flatwork with said laundry flatwork leading edge in the substantially taut condition towards such laundry processing means with such clamping means in the lowered biasing position.

10. The method of claim 9 in combination with the step of positioning a second portion of the flatwork leading edge extending from the leading edge portion engaging such clamping means beneath a second clamping means responsive to a second laundry flatwork sensing means and movable into an elevated position spaced from and a lowered position biased toward such movable conveyor; sensing the presence of the second portion of the flatwork leading edge beneath said second retractable clamping means whereby said second retractable clamping means is responsive to said second sensing means and lowered into the position biasing said flatwork second leading edge portion against such movable conveyor prior to actuation of such movable conveyor.

* * * * *

UNITED STATES PATENT AND TRADEMARK OFFICE

CERTIFICATE OF CORRECTION

PATENT NO. : 5,172,502

DATED : December 22, 1992

INVENTOR(S) : Kasimir Kober

It is certified that error appears in the above-indentified patent and that said Letters Patent is hereby corrected as shown below:

ON THE TITLE PAGE

In the Abstract, line 3, change "air" to --aid--.

In the Abstract, line 19, change "shoe" to --shoes--.

Column 1, line 35, after "Pat. No." insert --Re.--.

Column 2, line 52, change "elevation" to --elevational--.

Column 3, line 9, change "ironerfolder" to --ironer-folder--.

Column 7, line 17, change "actuation" to --actuating--.

Column 7, line 46, change "the" to --such--.

Signed and Sealed this

Sixteenth Day of May, 1995

*Attest:*

*Attesting Officer*

BRUCE LEHMAN

*Commissioner of Patents and Trademarks*